US008511529B2

(12) United States Patent
Lin

(10) Patent No.: US 8,511,529 B2
(45) Date of Patent: Aug. 20, 2013

(54) OSCILLATION REDUCING SUSPENSION DEVICE FOR A FAN MOTOR OF A COMBUSTION-POWERED TOOL

(75) Inventor: Yi-Peng Lin, Taichung (TW)

(73) Assignee: Basso Industry Corp, Taichung (TW)

( * ) Notice: Subject to any disclaimer, the term of this patent is extended or adjusted under 35 U.S.C. 154(b) by 258 days.

(21) Appl. No.: 12/948,414

(22) Filed: Nov. 17, 2010

(65) Prior Publication Data

US 2011/0116922 A1 May 19, 2011

(30) Foreign Application Priority Data

Nov. 19, 2009 (TW) ..... 98139308 A

(51) Int. Cl.
*B25C 1/14* (2006.01)

(52) U.S. Cl.
USPC ..... 227/10; 227/8; 227/130; 227/156

(58) Field of Classification Search
USPC ..... 227/8, 10, 130, 156
See application file for complete search history.

(56) References Cited

U.S. PATENT DOCUMENTS

| | | | | |
|---|---|---|---|---|
| 5,110,257 | A * | 5/1992 | Hibner et al. | 415/119 |
| 5,680,980 | A * | 10/1997 | Robinson | 227/10 |
| 5,713,313 | A * | 2/1998 | Berry | 123/46 SC |
| 6,520,397 | B1 * | 2/2003 | Moeller | 227/130 |
| 7,316,209 | B2 * | 1/2008 | Akiba et al. | 123/46 SC |
| 8,220,686 | B2 * | 7/2012 | Kestner et al. | 227/10 |
| 2006/0006207 | A1 * | 1/2006 | Akiba et al. | 227/10 |
| 2010/0237127 | A1 * | 9/2010 | Wu et al. | 227/10 |

FOREIGN PATENT DOCUMENTS

WO 2010/106192 A1 9/2010

OTHER PUBLICATIONS

Examination Report dated Mar. 16, 2011 for application No. GB1019373.8, 3 pp.

* cited by examiner

*Primary Examiner* — Brian D Nash
(74) *Attorney, Agent, or Firm* — Holland & Hart LLP

(57) ABSTRACT

An oscillation reducing suspension device for a fan motor of a combustion-powered tool includes a holding web member mounted on a cylinder head and having a central opening to be sleeved on the motor, first and second retaining members disposed to hoop around the motor, and first and second damping members each disposed between the holding web member and a respective one of the first and second retaining members so as to counteract an axial vibration force, thereby minimizing the impact of the axial vibration force.

7 Claims, 4 Drawing Sheets

OSCILLATION REDUCING SUSPENSION DEVICE FOR A FAN MOTOR OF A COMBUSTION-POWERED TOOL

CROSS-REFERENCE TO RELATED APPLICATION

This application claims priority of Taiwanese Patent Application No. 098139308, filed on Nov. 19, 2009, the disclosure of which is herein incorporated by reference.

BACKGROUND OF THE INVENTION

Field of the Invention

This invention relates to a combustion-powered tool, more particularly to an oscillation reducing suspension device for a fan motor of a combustion-powered tool, such as a pistol-like tool powered by a pressurized fuel gas for driving a fastener into a workpiece.

A fan motor suspension mechanism for a combustion-powered tool disclosed in U.S. Pat. No. 7,118,018 includes a cylinder head with a cavity to accommodate a fan motor therein. The armature shaft of the fan motor extends through a floor wall of the cavity to drive rotation of a fan that is disposed in a combustion chamber under the cylinder head for providing efficient combustion within the chamber. The suspension mechanism further includes an inner ring secured to the fan motor, an outer ring secured to the cylinder head, and a resilient web extending radially between the inner and outer rings to allow slight axial movement of the fan motor so as to provide resilience to the fan motor and thus shock absorption for the motor upon combustion. However, since the resilient web is liable to be deformed, the connection between the motor and the cylinder head is unstable, and slippage of the motor from the suspension mechanism may occur during oscillation.

Another motor suspension mechanism is disclosed in U.S. Pat. No. 6,619,527, and includes a rigid circular motor retaining cup attached to a fan motor to provide a heat and dirt barrier for the motor, and a mounting bracket secured to a cylinder head by means of fasteners and to the retaining cup by means of an annular resilient web that can protect the motor from axial acceleration and large oscillation. In addition, resilient spacer members are disposed between the mounting bracket and the cylinder head for protecting the motor from axial acceleration and oscillations, thereby rendering the construction of the suspension mechanism complicated and assembly inconvenient.

In co-pending U.S. patent application Ser. No. 12/386,878 entitled "Fan Motor for Combustion-powered Tool," and co-pending U.S. patent application Ser. No. 12/727,133 entitled "Oscillation Reducing Suspension Device for a Fan Motor of a Combustion-powered Tool" filed by the applicant, there are disclosed a vibration-absorbing or damping suspension device that couples a fan motor and a cylinder head to reduce axial oscillation of the fan motor.

SUMMARY OF THE INVENTION

An object of the present invention is to provide an oscillation reducting suspension device for a fan motor of a combustion-powered tool which has a simplified construction and which provides an efficient shock absorbing effect for reducing axial oscillation of the fan motor.

According to this invention, the oscillation reducing suspension device includes a holding web member having a central region which defines a central opening to be sleeved on a barrel wall of a fan motor, and a surrounding region which is adapted to be securely mounted on a cylinder head. First and second retaining members are mounted on the fan motor at two opposite sides of the central region in a direction of the rotary axis. A first damping member is disposed between the central region and the first retaining member, and a second damping member is disposed between the central region and the second retaining member so as to minimize impact of an axial vibration force on the fan motor.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
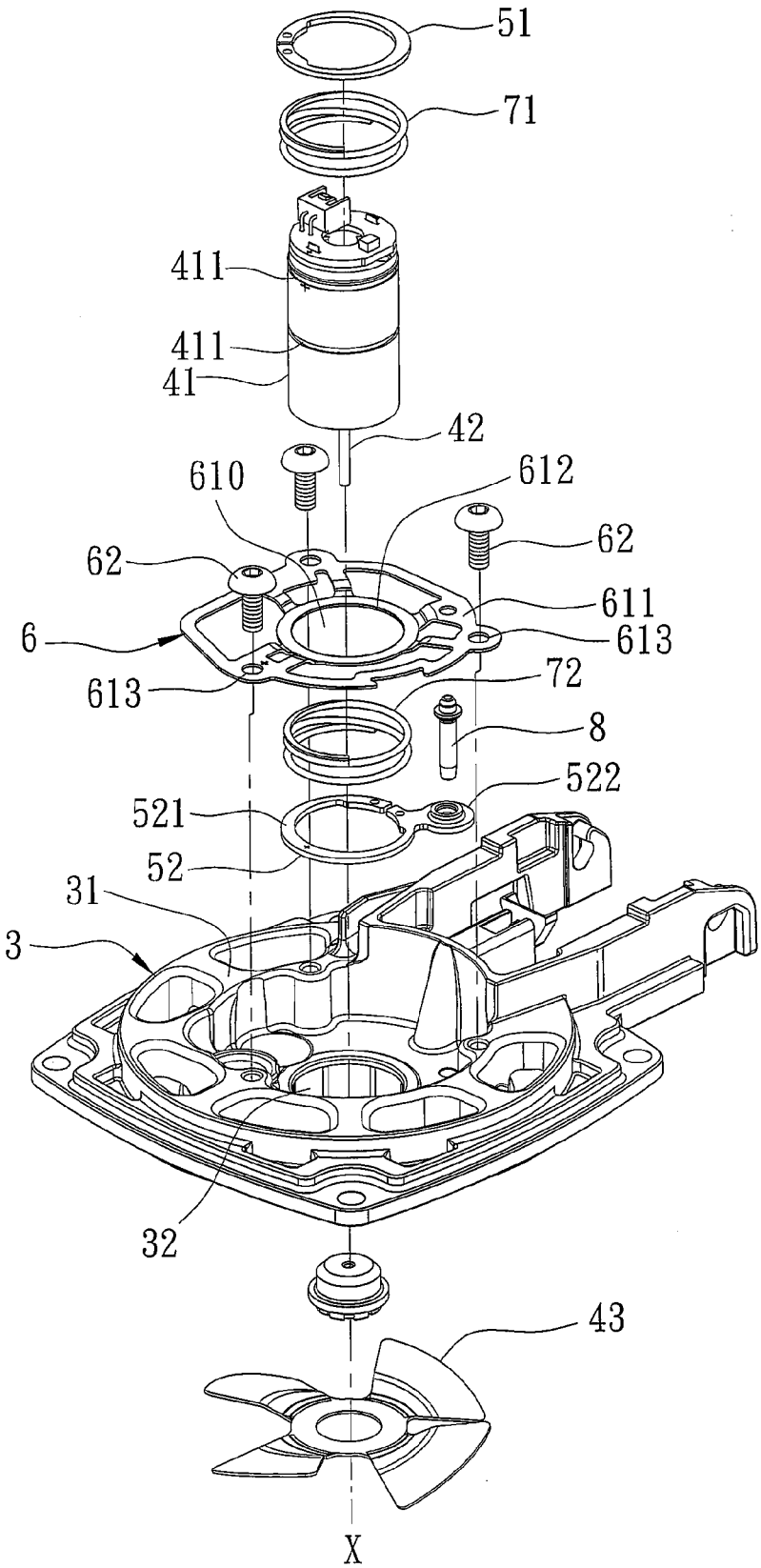
FIG. 1 is an exploded perspective view of a preferred embodiment of an oscillation reducing suspension device for a fan motor and a cylinder head of a combustion-powered tool according to this invention.
Figure 2:
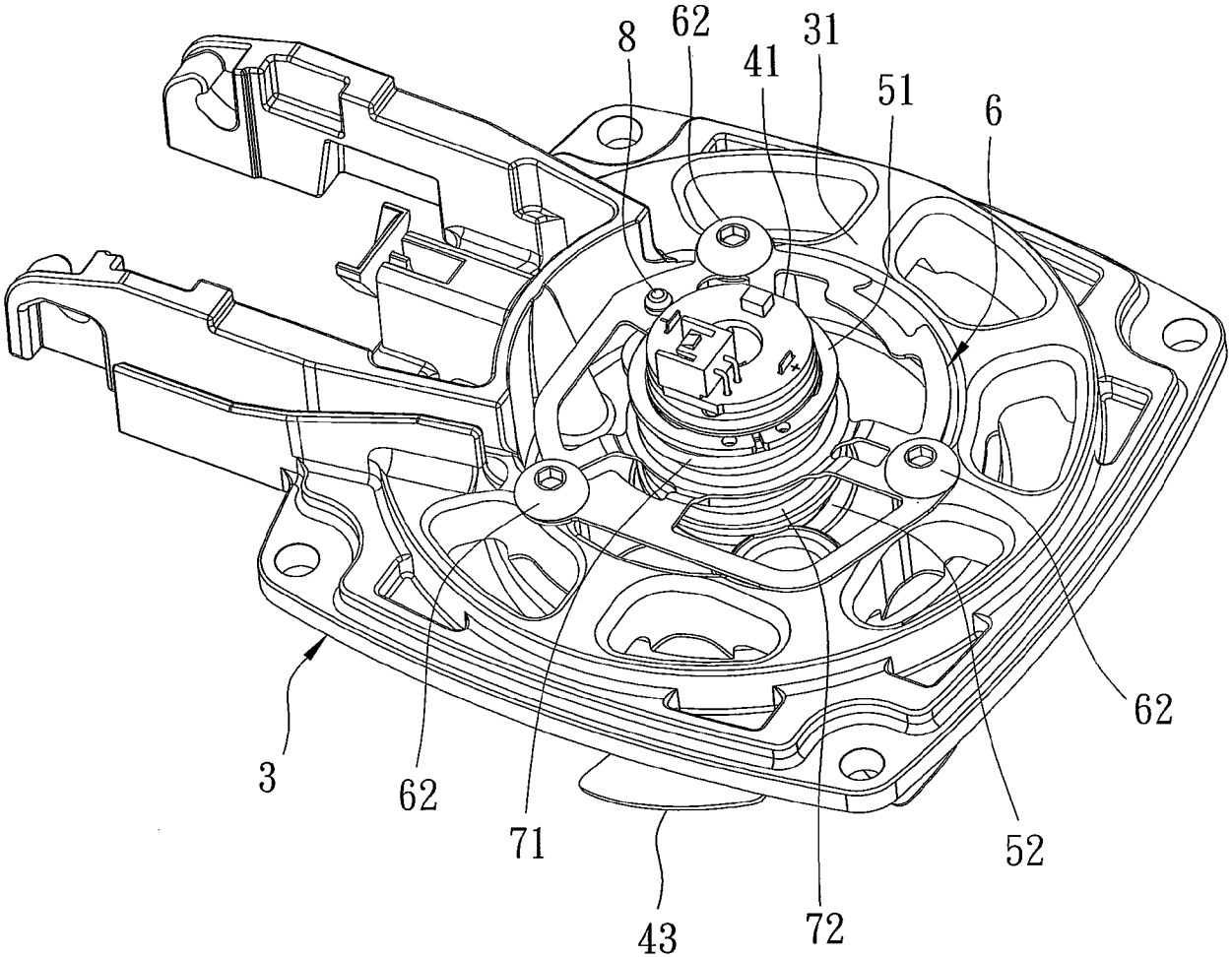
FIG. 2 is a perspective view of the preferred embodiment mounted on the cylinder head.
Figure 3:
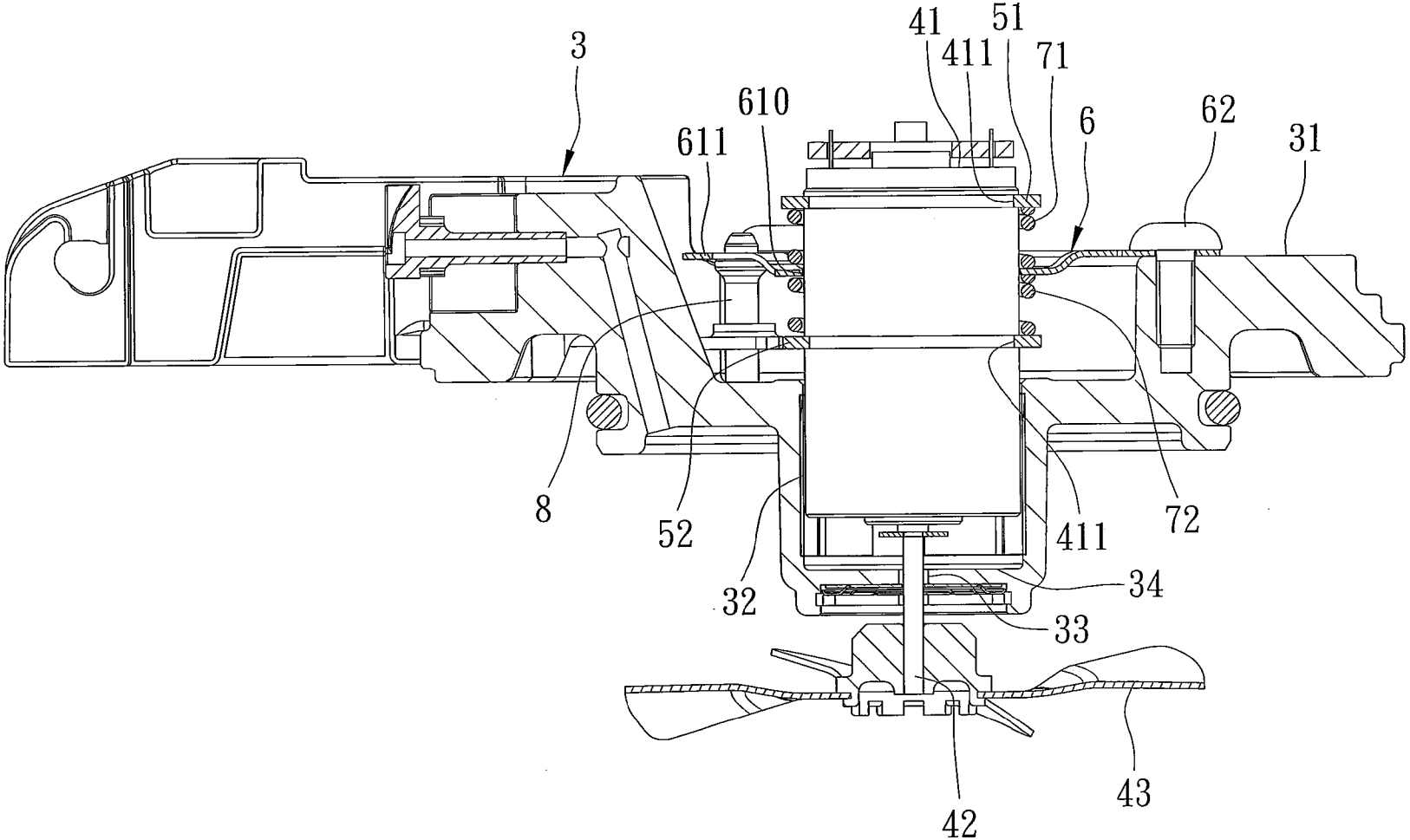
FIG. 3 is a sectional view of the preferred embodiment mounted on the cylinder head.

Referring to FIGS. 1 to 3, a preferred embodiment of an oscillation reducing suspension device for a fan motor 41 of a combustion-powered tool (not shown) according to the present invention is shown to be mounted in a cylinder head 3 of the combustion-powered tool, such as a pistol-like fastening hand tool. The cylinder head 3 is disposed to cover a combustion chamber (not shown) in the tool, and has an upper major surface 31 defining a cavity 32 that extends along a rotary axis (X) for accommodating the fan motor 41 and that terminates at a floor surface 34. The floor surface 34 has a passage 33 communicating the cavity 32 with the combustion chamber so as to permit an armature shaft 42 of the fan motor 41 to extend into the combustion chamber. A fan 43 is received in the combustion chamber to be rotated with the armature shaft 42. A barrel wall of the fan motor 41 has two annular grooves 411.

The oscillation reducing suspension device of the embodiment according to this invention comprises a holding web member 6, first and second retaining member 51, 52, first and second damping members 71, 72, and a post member 8.

The holding web member 6 is made from a rigid metal plate, and has a central region 612 which defines a central opening 610 to be sleeved on the barrel wall of the fan motor 41 so as to orient the fan motor 41 along the rotary axis (X), and a surrounding region 611 which is radially opposite to the central region 612, and which has a plurality of mounting holes 613 extending therethrough such that a plurality of fasteners 62 respectively extend through the mounting holes 613 to be secured on the upper major surface 31 of the cylinder head 3.

The first retaining member 51 is in the form of a hoop 51 which is retainingly engaged with one of the annular grooves 411 to be adapted to hoop around the barrel wall of the fan motor 41 at one side of the central region 612 in a direction of the rotary axis (X). The second retaining member 52 has a hoop body 521 which is retainingly engaged with the other one of the annular grooves 411 to be adapted to hoop around the barrel wall of the fan motor 41 at the other side of the central region 612, and a positioning lug 522 which extends radially from the hoop body 521, and which is disposed to be axially spaced apart from the surrounding region 611 of the holding web member 61.

In this embodiment, the first damping member 71 is a coil spring 71 which is sleeved on the barrel wall of the fan motor 41 and which abuts against the central region 612 and the first retaining member 51. The second damping member 72 is a coil spring 72 which is sleeved on the barrel wall of the fan motor 41 and which abuts against the central region 612 and the second retaining member 52.

The post member 8 is disposed to extend through the surrounding region 611 of the holding web member 6 and the positioning lug 522 of the second retaining member 52 to be secured on the upper major surface 31 of the cylinder head 3 so as to keep the central region 612 apart from the hoop body 521 and to ensure immobility of the barrel wall of the fan motor 41 in a circumferential direction.

In assembly, the second damping member 72, the holding web member 6 and the first damping member 71 are sequentially sleeved on the barrel wall of the fan motor 41, and the first and second retaining members 51, 52 are disposed in the respective annular grooves 411 so as to place the above-mentioned component parts on the fan motor 41. Subsequently, the assembly of the fan motor 41 is mounted securely on the upper major surface 31 of the cylinder head 3 to have the fan motor 41 received in the cavity 32.

Since the fan motor 41 is coupled to the cylinder head 3 through the first and second retaining members 51, 52, the first and second damping members 71, 72 and the holding web member 61, an axial vibration force which is generated as a result of subjecting the fan motor 41 to a first acceleration opposite a power stroke of a piston/drive blade and a fastener upon combustion in the combustion chamber, and which is generated as a result of subjecting the fan motor 41 to a second acceleration opposite the first acceleration when the momentum of the piston/driver blade is stopped in milliseconds of the combustion, is counteracted by the first and second damping members 71, 72 through the holding web member 6 and the first and second retaining members 51, 52, thereby minimizing impact of the axial vibration force on the fan motor 41.

By virtue of the first and second damping members 71, 72 that are coil springs sleeved around the fan motor 41 and that are spiral about the rotary axis (X), the axial vibration force can be directly and quickly distributed through the first and second damping members 71, 72 so as to reduce the impact thereof. Further, by virtue of the rigid metal-made holding web member 6, the fan motor 41 can be firmly secured to the cylinder head 3 in a convenient manner.

Figure 4:
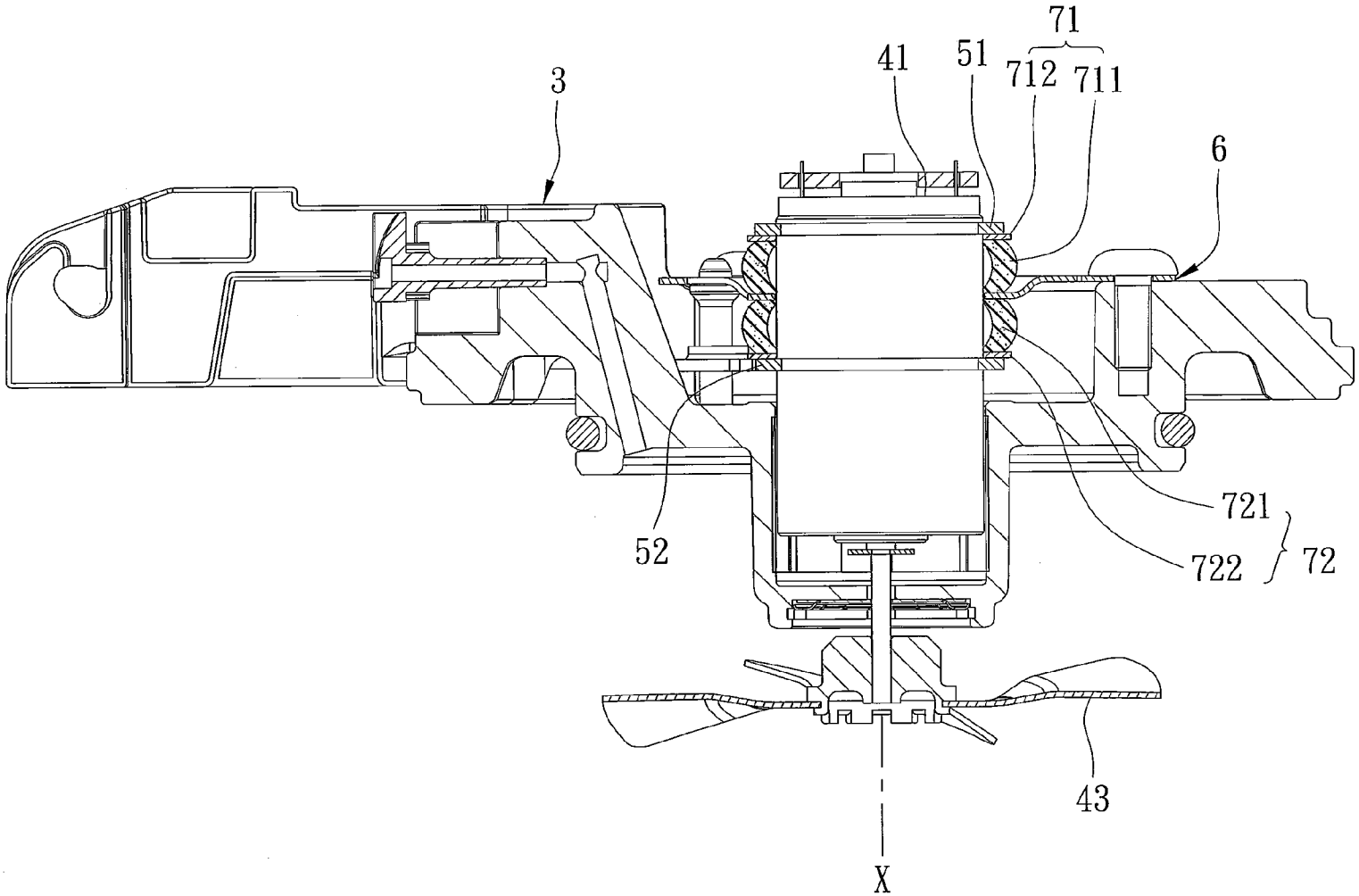
FIG. 4 is a sectional view of another preferred embodiment of the oscillation reducing suspension device according to this invention.

Referring to FIG. 4, another preferred embodiment of the oscillation reducing suspension device according to this invention is shown to be similar to that of the previous embodiment, except that the first damping member 71 includes a first elastomeric sleeve 711 and a first washer 712 surrounding the fan motor 41 and respectively abutting against the holding web member 6 and the first retaining member 51, and the second damping member 72 includes a second elastomeric sleeve 721 and a second washer 722 surrounding the fan motor 41 and respectively abutting against the holding web member 6 and the second retaining member 52.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An oscillation reducing suspension device for a fan motor of a combustion-powered tool, the combustion-powered tool including a cylinder head which is disposed to cover a combustion chamber, and which has an upper major surface defining a cavity that extends along a rotary axis for accommodating the fan motor and which terminates at a floor surface that has a passage to communicate the cavity with the combustion chamber so as to permit an armature shaft of the fan motor to extend into the combustion chamber, and a fan which is received in the combustion chamber, and which is rotated with the armature shaft, said oscillation reducing suspension device comprising:

a holding web member having a central region which defines a central opening to be sleeved on a barrel wall of the fan motor, and a surrounding region which is opposite to said central region in radial directions, and which is adapted to be securely mounted on the upper major surface of the cylinder head;

a first retaining member adapted to be mounted on the barrel wall of the fan motor and disposed at one side of said central region in a direction of the rotary axis;

a second retaining member adapted to be mounted on the barrel wall of the fan motor and disposed at the other side of said central region, opposite the one side of said central region; and a first damping member formed to be sleeved on the barrel wall of the fan motor, and disposed between said central region and said first retaining member, and a second damping member formed to be sleeved on the barrel wall of the fan motor, and disposed between said central region and said second retaining member so as to minimize impact of an axial vibration force on the fan motor.

2. The oscillation reducing suspension device according to claim 1, wherein said first retaining member is in form of a hoop adapted to hoop around the barrel wall of the fan motor, and said second retaining member has a hoop body adapted to hoop around the barrel wall of the fan motor.

3. The oscillation reducing suspension device according to claim 2, wherein said second retaining member further has a positioning lug which extends radially from said hoop body, and which is disposed to be axially spaced apart from said surrounding region of said holding web member, and further comprising a post member adapted to be secured on the upper major surface of the cylinder head and interconnecting said positioning lug and said surrounding region so as to keep said central region apart from said hoop body and to ensure immobility of the barrel wall of the fan motor in a circumferential direction.

4. The oscillation reducing suspension device according to claim 2, wherein each of said first and second damping members is a coil spring configured to abut against said central region and a corresponding one of said first and second retaining members.

5. The oscillation reducing suspension device according to claim 2, wherein each of said first and second damping members includes an elastomeric sleeve and a washer configured to surround the barrel wall of the fan motor and to abut respectively against said central region and a corresponding one of said first and second retaining members.

6. The oscillation reducing suspension device according to claim 1, wherein said holding web member is made from a metal plate.

7. The oscillation reducing suspension device according to claim 6, wherein said holding web member has a plurality of mounting holes extending through said surrounding region, and a plurality of fasteners respectively extending through said mounting holes to be secured on the upper major surface of the cylinder head.

* * * * *